US007325965B2

(12) United States Patent
Lingemann et al.

(10) Patent No.: US 7,325,965 B2
(45) Date of Patent: Feb. 5, 2008

(54) LOCKING SOCKET FOR BIAX PLUG-IN LAMP

(75) Inventors: Erwin Lingemann, Arnsberg (DE); Karl-Wilhelm Vogt, Ense (DE)

(73) Assignee: BJB GmbH & Co. KG, Arnsberg (DE)

( * ) Notice: Subject to any disclaimer, the term of this patent is extended or adjusted under 35 U.S.C. 154(b) by 205 days.

(21) Appl. No.: 11/311,933

(22) Filed: Dec. 19, 2005

(65) Prior Publication Data

US 2006/0133082 A1 Jun. 22, 2006

(30) Foreign Application Priority Data

Dec. 20, 2004 (DE) ..... 10 2004 062 414

(51) Int. Cl.
*H01R 33/00* (2006.01)

(52) U.S. Cl. ..... 362/655; 362/659; 439/227; 439/332

(58) Field of Classification Search ..... 362/652, 362/659, 655–657; 439/227, 332
See application file for complete search history.

(56) References Cited

U.S. PATENT DOCUMENTS 5,746,615 A 5/1998 Ichikawa
6,340,310 B2 1/2002 Henrici

*Primary Examiner*—Stephen F. Husar
(74) *Attorney, Agent, or Firm*—Andrew Wilford

(57) ABSTRACT

A lamp has a polygonal-section plug part extending along an axis and having at least one radially outwardly directed face formed with a radially outwardly projecting retaining bump. A socket has a core body formed with a polygonal-section socket hole complementary to the plug part and into which the plug part can be fitted axially in an installed position and that substantially completely prevents angular displacement of the plug part relative to the core body in the installed position. A sleeve surrounds the core body and can angularly shift relative thereto between a freeing end position and a blocking end position. The sleeve is formed with a radially inwardly projecting retaining formation that, in the installed position of the plug part, is angularly offset from the bump in the freeing position and that operatively engages and blocks axial displacement of the bump in the blocking position.

14 Claims, 5 Drawing Sheets

LOCKING SOCKET FOR BIAX PLUG-IN LAMP

FIELD OF THE INVENTION

The present invention relates to an electrical lamp socket. More particularly this invention concerns such a socket for a biax plug-in lamp, e.g. of the G23 or G24 type.

BACKGROUND OF THE INVENTION

A standard biax plug-in lamp, e.g. a fluorescent lamp intended to fit in a socket of the G23 or G24 type, has a base from which a normally square plug part projects axially, with several contact pins projecting from the base parallel to the axis next to the plug part. The socket for such a lamp has a socket hole complementary to the plug part and, to the sides of the hole, respective contact holes into which the contact pins fit when the plug part is engaged in the socket hole, with metal contacts in the contact holes making the necessary electrical connection to the contact pins. The socket hole is dimension to fit only with the plug part of a lamp with the right rating, and often complementary index ridges and grooves are provided in the socket hole and on the plug part to ensure that only a lamp exactly right for the fixture can be fitted to the socket.

In U.S. Pat. No. 6,340,310 of Henrici such a socket is disclosed having spring-loaded gripping fingers that engage behind retaining bumps on the plug part when the plug part is fully inserted in the socket hole. This interfit ensures that the lamp will be gripped solidly enough that it will not fall out of the socket if installed on a ceiling, and that in general accidental light engagement or vibration will not cause the lamp to work free.

In U.S. Pat. No. 5,746,615 the socket is constructed such that the lamp can be inserted into the socket and then twisted to bring retaining bumps on the plug part under complementary retaining formations on the socket part, that when twisted into the right position lock the lamp in place. This structure is fairly complex in that it is necessary to provide special contact systems to grip the contact pins when they are pivoted into the locked position. In addition the socket is somewhat bulky since the lamp must be able to pivot in it, and even so the lamp can work loose if it is inadvertently given a pull or subjected to substantial vibration.

OBJECTS OF THE INVENTION

It is therefore an object of the present invention to provide an improved locking socket for a biax plug-in lamp.

Another object is the provision of such an improved locking socket for a biax plug-in lamp that overcomes the above-given disadvantages, in particular that securely holds the lamp in place so that no unintentional action on the lamp itself will be able to dislodge it.

A further object is to provide an improved locking socket that can be used with existing lamps.

SUMMARY OF THE INVENTION

A lamp has a polygonal-section plug part extending along an axis and having at least one radially outwardly directed face formed with a radially outwardly projecting retaining bump. A socket has according to the invention a core body formed with a polygonal-section socket hole complementary to the plug part and into which the plug part can be fitted axially in an installed position and that substantially completely prevents angular displacement of the plug part relative to the core body in the installed position. A sleeve surrounds the core body and can angularly shift relative thereto between a freeing end position and a blocking end position. The sleeve is formed with a radially inwardly projecting retaining formation that, in the installed position of the plug part, is angularly offset from the bump in the freeing position and that operatively engages and blocks axial displacement of the bump in the blocking position. Thus in the installed position of the plug part the lamp can be withdrawn from the socket in the freeing position of the sleeve but is locked and cannot be withdrawn in the blocking position of the sleeve.

With the system of this invention it is relative angular displacement of the sleeve and core part that lock or unlock the lamp from the socket. No pulling on the lamp will free it. The instant invention is usable with lamps adapted to fit standard G23 or G24 sockets, so that no variation in the actual structure of the lamp is needed.

According to the invention the lamp is provided adjacent the plug part with axially extending conductive contact pins and the core body is formed with contact holes in which the pins are engageable and is provided in the contact holes with contacts. In addition the core part, sleeve, and plug part are dielectric. The contact pins on the lamp and the contacts in the core part do not move angularly relative to each other, but instead they are merely fitted axially together. Thus the electrical connection here is simple and not likely to fail, as in systems like that of above-cited U.S. '615 where the contact pins have to slide angularly in their contacts. The part that locks the lamp in place has nothing to do with the electrical connection made with the lamp.

The retaining formation of the sleeve can be an inwardly projecting bump. This structure is very simple. Here the core part is formed with a radially outwardly open aperture through which the retaining-formation bump of the sleeve is operatively engageable with the retaining formation.

There are according to the invention interengaging formations on the core body and the sleeve for preventing relative axial displacement while permitting limited relative angular displacement. Furthermore the sleeve can be externally formed with screwthread ridges so that a mounting ring can be screwed to the sleeve. A mounting cup provided with axially extending retaining fingers can fit with the socket, with the fingers engaging in slots in the sleeve. Thus the sleeve and mount are axially fixed together, and the core part pivots about the axis in the sleeve.

In accordance with the invention a radially deflectable retaining spring is mounted in the hole of the core body and engageable over the bump, as in above cited U.S. '310. The retaining spring is positioned in the core body such that on insertion or removal of the plug part from the socket hole it is radially outwardly deflected. The retaining formation radially inwardly engages the retaining spring in the blocking position.

According to a particularly effective feature of this invention an ejecting spring is mounted in the core body and bears on the plug part to urge same axially out of the socket hole in the installed position. This ejecting spring exerts an axially outward force on the plug part in the installed position that is greater than an axially inward vector of the force exerted by the retaining spring on the bump. Thus the lamp will not normally be able to sit in the installed position unless it is positively pressed down by the installer or it is locked by relative angular shifting of the core and sleeve.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
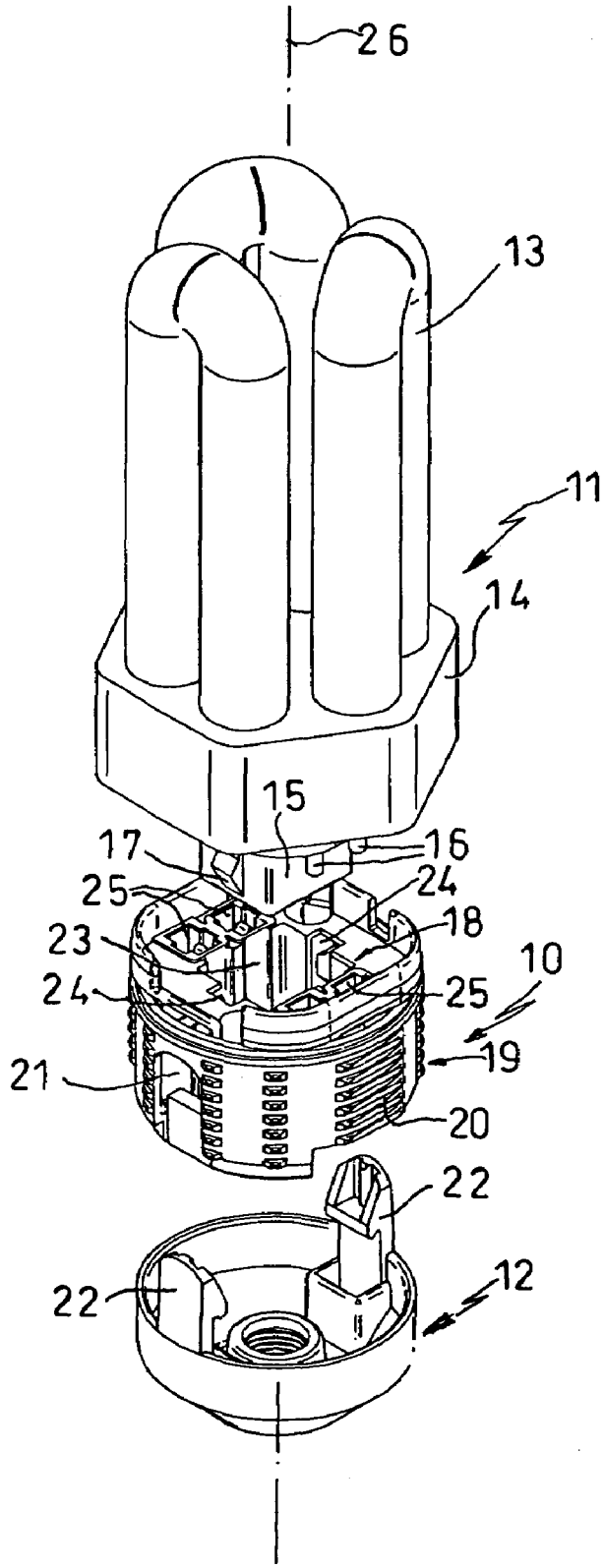
FIG. 1 is a perspective exploded view of the lamp and socket according to the invention.

As seen in FIG. 1 a socket 10 can receive a lamp 11 and is adapted to be held in a mounting cup 12, all generally centered on a normally vertical axis 26.

The lamp 11 comprises three U-shaped fluorescent tubes 13 seated in a plastic or ceramic base 14 from which a normally plastic square section plug part 15 extends along the axis 26. Spaced from two opposite faces of the part 15 are axially extending contact pins 16, and the other opposite faces of the part 15 are formed with radially outwardly projecting V-shaped retaining bumps 17, identical to those in above-cited U.S. patents '310 and '615 and coacting with retaining springs 32 shown in FIGS. 6 and 7.

The socket 10 comprises a molded plastic core part 18 surrounded by a molded-plastic sleeve 19. The sleeve 19 is formed with radially outwardly projecting and helically extending screwthread ridges 20 and with a pair of axially downwardly opening slots 21 adapted to fit with complementary retaining fingers 22 on the base 12. The sleeve 19 and mount 12 are normally stationary.

Figure 4:
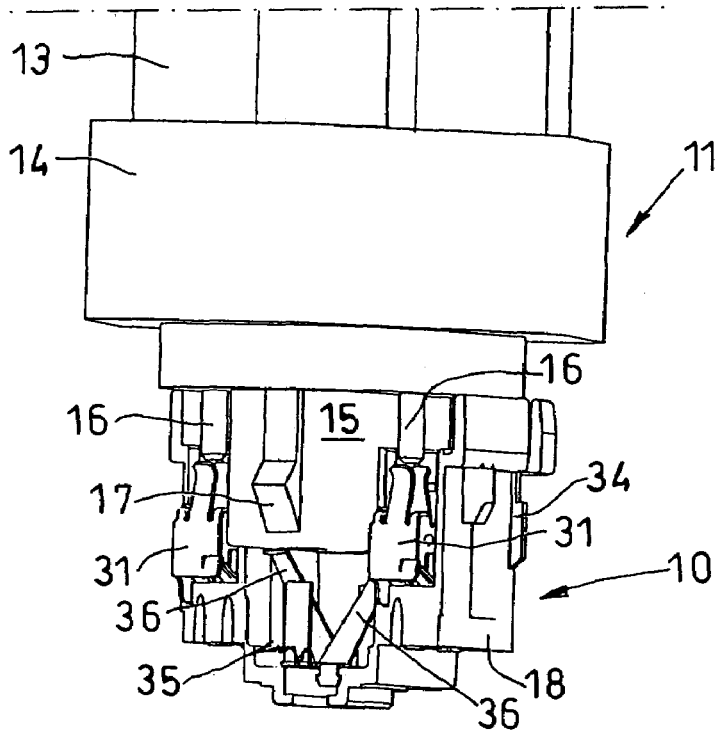
FIG. 4 is a side view partly in section showing the socket and lamp with the lamp partially inserted but with the outer sleeve part of the socket removed for clarity of view.
Figure 5:
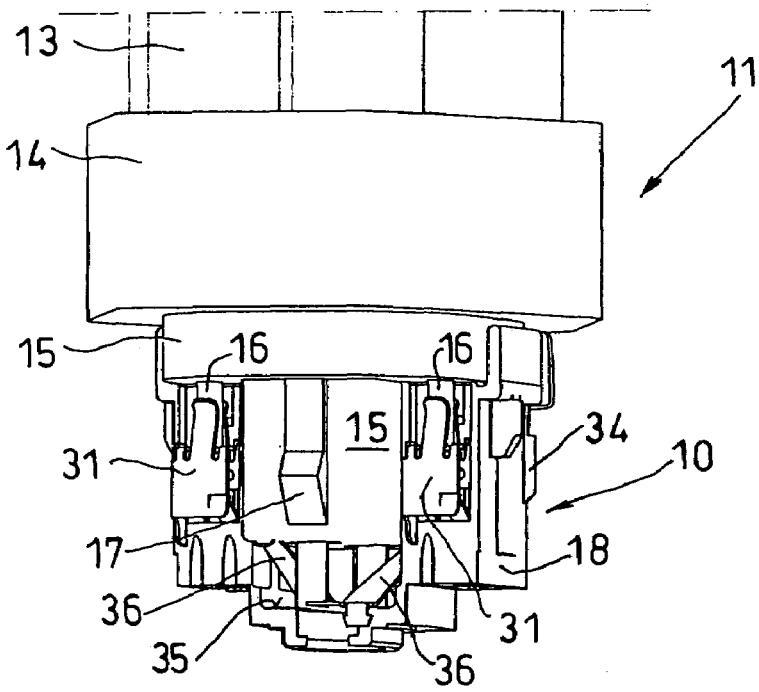
FIG. 5 is a view like FIG. 4 but with the lamp fully inserted.

The core part 18 is formed with a central square-section hole 23 complementary to the plug part 15 and having on opposite inwardly directed planar faces axially extending and radially inwardly open grooves 24 along which the bumps 17 can slide. Adjacent each of the other sides of the hole 23 are two contact holes 25 fitted as shown in FIGS. 4 and 5 with fork-shaped gripper contacts 31 that can engage and hold the pins 16. Unillustrated connection wires extend from the metal contacts 31 out the bottom of the part 18 and mount 12. When the plug part 15 is fitted in the socket hole 23, no relative angular movement is possible between the lamp 11 and core part 18.

Figure 2:
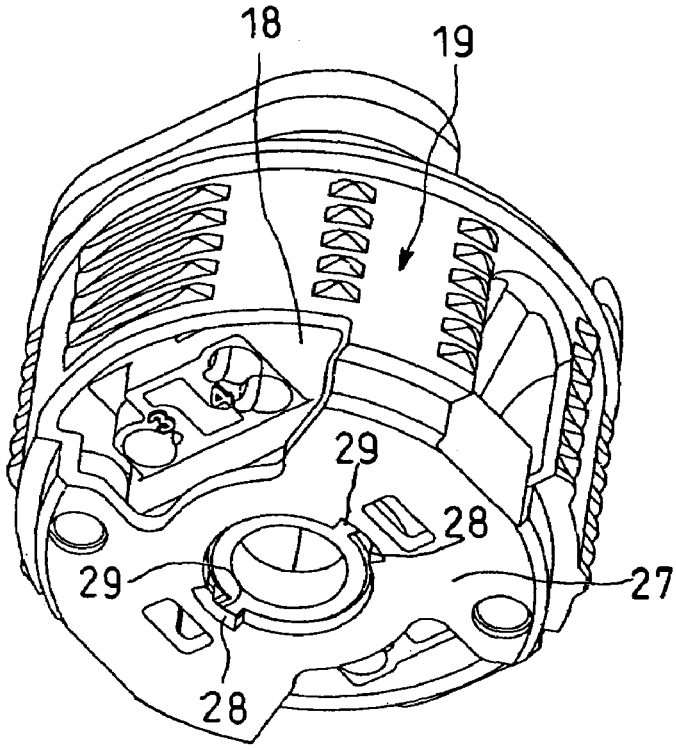
FIG. 2 is a large-scale perspective view from below of the socket.
Figure 3:
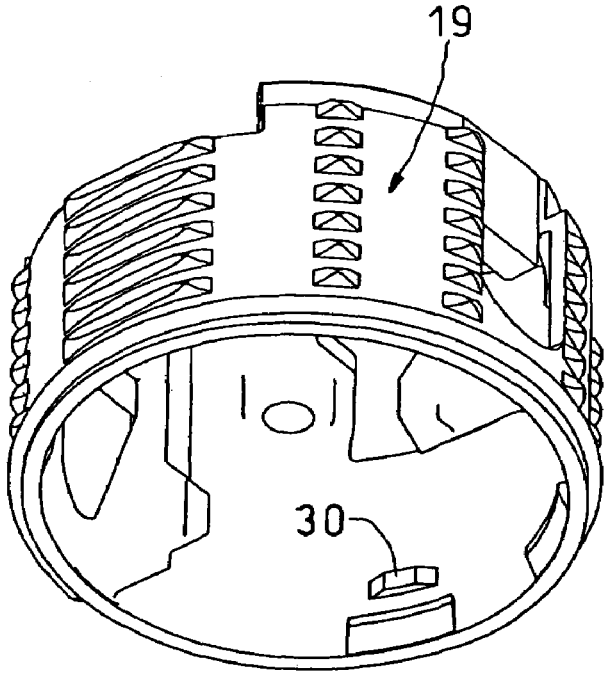
FIG. 3 is a perspective view into the top of the socket sleeve.

Angularly extending and radially inwardly open notches 28 shown in FIG. 2 are formed in a bottom wall or floor 27 of the part 18 and hold narrower teeth 29 that project radially from the part 18 to allow the sleeve 19 and core part to pivot limitedly, e.g. through about 15°, about the axis 26 relative to each other. In addition radially inwardly projecting bumps 30 formed in the sleeve 19 can coact with ridges or tabs 34 (FIGS. 4 and 5) formed on the base 18 to axially secure the parts together and define the angularly offset end positions.

Figure 6:
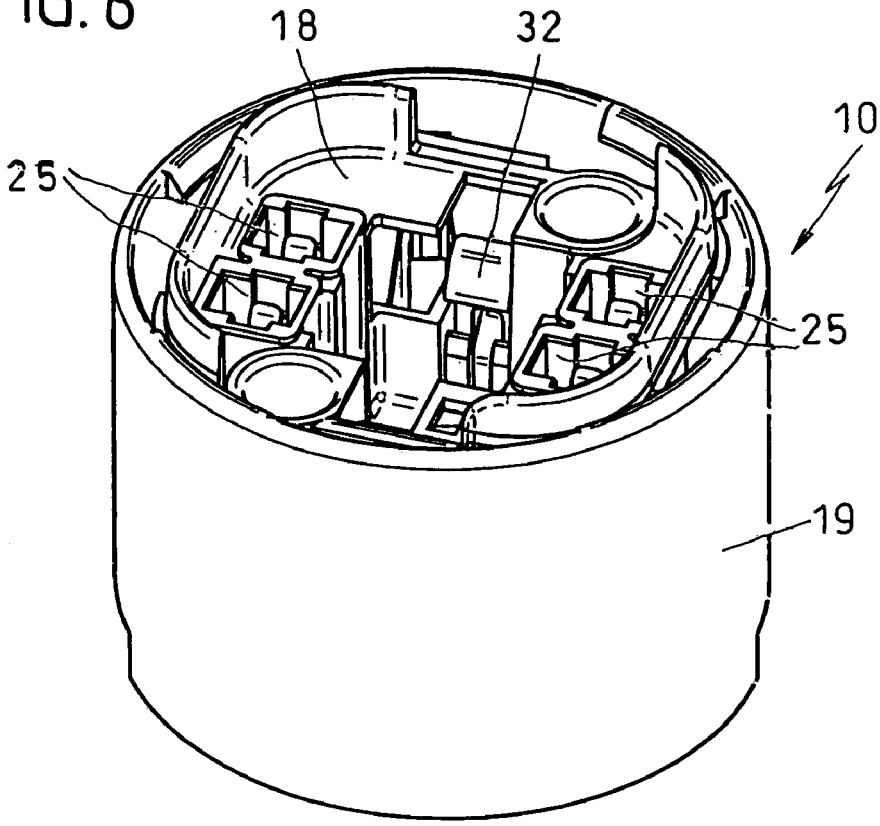
FIG. 6 is a perspective view of the top of the socket according to the invention.
Figure 7:
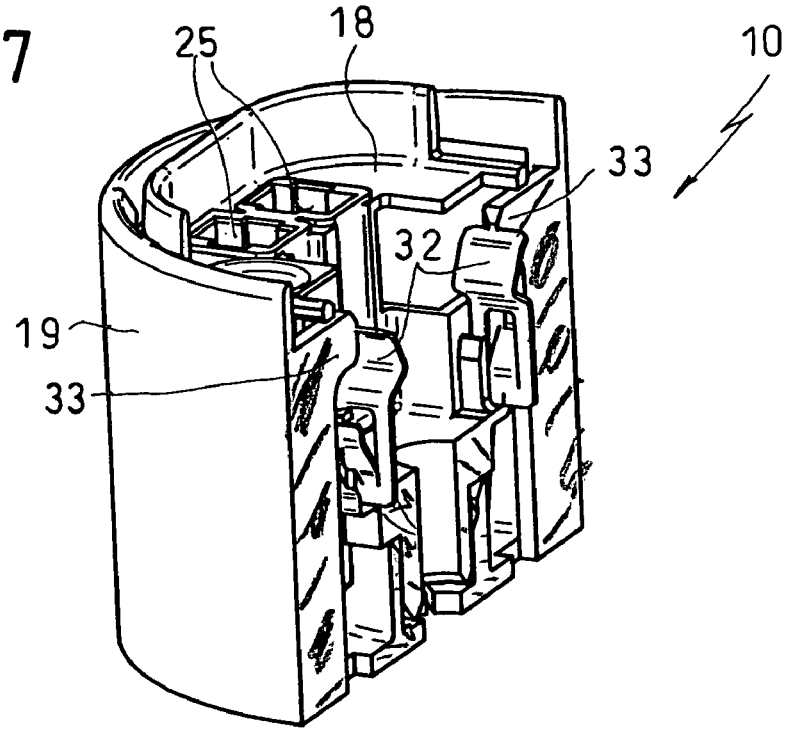
FIG. 7 is an axial section through the socket of FIG. 7.
Figure 8:
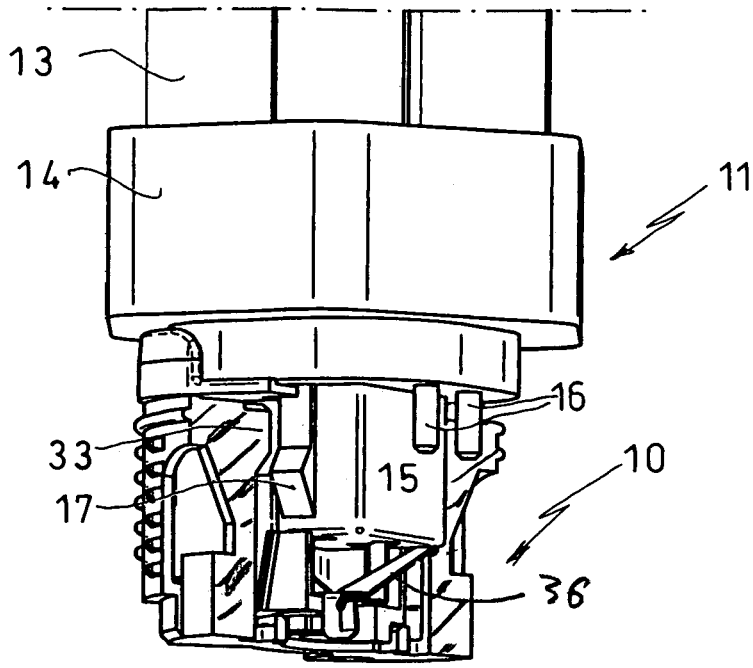
FIG. 8 is a partly sectional side view of a variant on the assembly with the sleeve in the freeing position.
Figure 9:
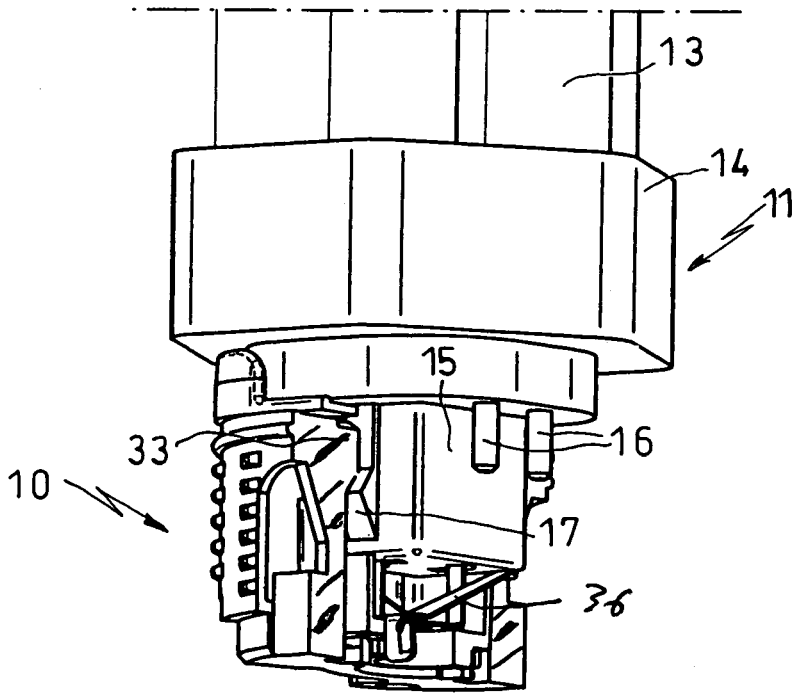
FIG. 9 is a view like FIG. 8 but in the blocked position.

As shown in FIGS. 4, 5, 8, and 9 the core 18 according to the invention has a floor 35 provided with leaf springs 36 that are bent downward as the lamp 11 is inserted in the socket 10. In addition as shown in FIGS. 6 and 7, the sleeve 19 has formations or bumps 33 that can fit against the outer sides of the retaining springs 32. In FIGS. 8 and 9 there are no springs 32, but the formations 33 can fit directly against the bumps 17. In a freeing end position of the sleeve 19 these bumps 33 are offset from the bumps 17 and/or springs 32. In an opposite blocking end position these bumps 33 engage against the outside faces of these springs 32 and prevent them from deflecting radially outward, or (FIGS. 8 and 9) engage into the grooves 24 and prevent the bumps 17 from moving axially along them.

Thus with the system of this invention the sleeve 19 is first shifted into the freeing end position in which it allows the springs 32 to deflect or (FIGS. 8 and 9) clears the grooves 24. Then as shown in FIGS. 4 and 5 the lamp 11 is inserted into the socket, which action in the embodiment of FIGS. 1 to 7 forces the bumps 17 past the springs 32, deflecting them outward, and an all cases pushes the pins 16 into the contacts 31. This action also compresses the springs 36 so that they exert a substantial force against the lamp 11 urging it axially back out of the socket.

Once in this position as shown in FIG. 5, the core part 8 and sleeve 19 are relatively angularly displaced to shift the sleeve 19 into the blocking end position of FIG. 7, bearing inward on the springs 32 and preventing them from moving outward or as shown in FIG. 9 fitting over the bumps 17 and preventing them from shifting outward. The result is that the lamp 11 is locked in the socket 10 and no action on the lamp 11 itself can remove it. Even if the lamp 11 is jostled, it will stay in place. Only relative pivoting of the core part 18 and sleeve 19 to free the springs 32 or the bumps 17 will permit removal of the lamp 11.

In the embodiment of FIGS. 1 to 7 the axial outward or upward force exerted by the springs 36 on the lamp 11 is greater than the axial inward or downward component of the force exerted by the springs 32 on the bumps 32. Thus assuming the lamp 11 is locked in place, rotating the sleeve 19 will release it so the springs 36 can push it up into the FIG. 4 partially inserted position, making removal very easy. With both embodiments it will be necessary for the lamp installer to hold the lamp 11 in place in the FIG. 5 installed position while the sleeve 19 or core 18 is turned to lock the assembly, whether the bumps are acting on the springs 32 or directly on the bumps 17.

We claim:

1. In combination with a lamp having a polygonal-section plug part extending along an axis and having at least one radially outwardly directed face formed with a radially outwardly projecting retaining bump, a socket comprising:

a core body formed with a polygonal-section socket hole complementary to the plug part and into which the plug part can be fitted axially in an installed position and that substantially completely prevents angular displacement of the plug part relative to the core body in the installed position; and a sleeve surrounding the core body and angularly displaceable relative thereto between a freeing end position and a blocking end position, the sleeve being formed with a radially inwardly projecting retaining formation that, in the installed position of the plug part, is angularly offset from the bump in the freeing position and that operatively engages and blocks axial displacement of the bump in the blocking position, whereby, in the installed position of the plug part, the lamp can be withdrawn from the socket in the freeing position of the sleeve but is locked and cannot be withdrawn in the blocking position of the sleeve.

2. The lamp/socket combination defined in claim 1 wherein the lamp is provided adjacent the plug part with axially extending conductive contact pins and the core body is formed with contact holes in which the pins are engageable and is provided in the contact holes with contacts.

3. The lamp/socket combination defined in claim 1 wherein the core part, sleeve, and plug part are dielectric.

4. The lamp/socket combination defined in claim 1 wherein the retaining formation of the sleeve is an inwardly projecting bump.

5. The lamp/socket combination defined in claim 4 wherein the core part is formed with a radially outwardly open aperture through which the retaining-formation bump of the sleeve is operatively engageable with the retaining formation.

6. The lamp/socket combination defined in claim 1, further comprising means including interengaging formations on the core body and the sleeve for preventing relative axial displacement while permitting limited relative angular displacement.

7. The lamp/socket combination defined in claim 1 wherein the sleeve is externally formed with screwthread ridges, whereby a mounting ring can be screwed to the sleeve.

8. The lamp/socket combination defined in claim 1, further comprising a mounting cup provided with axially extending retaining fingers, the sleeve being provided with slots in which the fingers can engage.

9. The lamp/socket combination defined in claim 1, further comprising a radially deflectable retaining spring mounted in the hole of the core body and engageable over the bump, the spring being positioned in the core body such that on insertion or removal of the plug part from the socket hole the spring is radially outwardly deflected, the retaining formation radially inwardly engaging the retaining spring in the blocking position.

10. The lamp/socket combination defined in claim 9, further comprising an ejecting spring mounted in the core body and bearing on the plug part to urge same axially out of the socket hole in the installed position.

11. The lamp/socket combination defined in claim 10 wherein the ejecting spring exerts an axially outward force on the plug part in the installed position that is greater than an axially inward vector of the force exerted by the retaining spring on the bump.

12. The lamp/socket combination defined in claim 1, further comprising an ejecting spring mounted in the core body and bearing on the plug part to urge same axially out of the socket hole in the installed position.

13. In combination with a lamp having a polygonal-section plug part extending along an axis and having at least one radially outwardly directed face formed with a radially outwardly projecting retaining bump, a socket comprising:

a core body formed with a polygonal-section socket hole complementary to the plug part and into which the plug part can be fitted axially in an installed position and that substantially completely prevents angular displacement of the plug part relative to the core body in the installed position;

a radially deflectable retaining spring mounted in the hole of the core body and engageable over the bump, the spring being positioned in the core body such that on insertion or removal of the plug part from the socket hole the spring is radially outwardly deflected; and a sleeve surrounding the core body and angularly displaceable relative thereto between a freeing end position and a blocking end position, the sleeve being formed with a radially inwardly projecting retaining formation that is angularly offset from the spring in the freeing position and that radially inwardly bears on the spring in the blocking position, whereby, in the installed position of the plug part, the lamp can be withdrawn from the socket in the freeing position of the sleeve but is locked and cannot be withdrawn in the blocking position of the sleeve.

14. In combination with a lamp having a polygonal-section plug part extending along an axis and having at least one radially outwardly directed face formed with a radially outwardly projecting retaining bump, a socket comprising:

a core body formed with a polygonal-section socket hole complementary to the plug part and into which the plug part can be fitted axially in an installed position and that substantially completely prevents angular displacement of the plug part relative to the core body in the installed position; and a sleeve surrounding the core body and angularly displaceable relative thereto between a freeing end position and a blocking end position, the sleeve being formed with a radially inwardly projecting retaining formation that, in the installed position of the plug part, is angularly offset from the bump in the freeing position of the sleeve and that radially overlaps and blocks axial displacement of the bump in the blocking position of the sleeve, whereby, in the installed position of the plug part, the lamp can be withdrawn from the socket in the freeing position of the sleeve but is locked and cannot be withdrawn in the blocking position of the sleeve.

* * * * *